US011589715B2

(12) United States Patent
Meyers et al.

(10) Patent No.: US 11,589,715 B2
(45) Date of Patent: Feb. 28, 2023

(54) GRAB BAR FOR SUPPORT IN VARIOUS ENVIRONMENTS

(71) Applicant: Bradley Fixtures Corporation, Menomonee Falls, WI (US)

(72) Inventors: Josh Meyers, Menomonee Falls, WI (US); Scott Kluck, Mequon, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 17/417,464

(22) PCT Filed: Dec. 18, 2019

(86) PCT No.: PCT/US2019/067153
§ 371 (c)(1),
(2) Date: Jun. 23, 2021

(87) PCT Pub. No.: WO2020/139659
PCT Pub. Date: Jul. 2, 2020

(65) Prior Publication Data

US 2022/0071456 A1 Mar. 10, 2022

Related U.S. Application Data

(60) Provisional application No. 62/785,992, filed on Dec. 28, 2018.

(51) Int. Cl.
*A47K 3/12* (2006.01)
*A47K 17/02* (2006.01)

(52) U.S. Cl.
CPC ..... *A47K 3/12* (2013.01); *A47K 17/022* (2013.01)

(58) Field of Classification Search
CPC ..... A47K 3/12; A47K 17/022; A47K 17/024
USPC ..... 248/291.1, 282.1, 278.1; 16/436, 438, 16/445, 110.1, 430, 111 R, 126
See application file for complete search history.

(56) References Cited

U.S. PATENT DOCUMENTS 3,286,283 A * 11/1966 Bertoldo ..... A61G 7/053 5/662
D242,671 S 12/1976 Thomas
(Continued)

FOREIGN PATENT DOCUMENTS

EP 3 146 878 A1 3/2017
GB 0 943 137 A 11/1963
(Continued)

OTHER PUBLICATIONS

American Specialties, Inc. Technical Data Sheet. "Swing-Up Grab Bar With Support Leg". Revised Aug. 19, 2015.
(Continued)

*Primary Examiner* — Muhammad Ijaz
(74) *Attorney, Agent, or Firm* — Foley & Lardner LLP

(57) ABSTRACT

A grab bar includes a continuous support bar extending between a first end and a second end vertically spaced apart from the first end. The continuous support bar has a top section extending away from the first end, a bottom section extending away from the second end and angling upward toward the top section, and a bend formed between and connecting the top section and the bottom section. A brace member is coupled to and extends between the top section and the bottom section.

17 Claims, 7 Drawing Sheets

(56) References Cited

U.S. PATENT DOCUMENTS

| | | | | |
|---|---|---|---|---|
| 4,250,815 | A * | 2/1981 | Swanson | A47B 57/10 108/147.11 |
| D270,216 | S | 8/1983 | Kusner | |
| D281,440 | S | 11/1985 | Petersson | |
| D304,415 | S | 11/1989 | Regan | |
| 4,908,906 | A * | 3/1990 | Hanna | A47K 17/024 16/445 |
| 5,590,440 | A * | 1/1997 | Pelt | A47K 17/024 16/342 |
| 6,276,027 | B1 | 8/2001 | Hanna | |
| 7,175,234 | B1 * | 2/2007 | Hsieh | A47C 9/06 297/313 |
| D596,278 | S * | 7/2009 | Stimpson | D23/304 |
| D631,270 | S | 1/2011 | O'Brien et al. | |
| D654,157 | S | 2/2012 | Gilbert | |
| D679,925 | S | 4/2013 | O'Brien et al. | |
| 8,661,740 | B2 * | 3/2014 | Lin | E06B 11/085 297/DIG. 10 |
| D733,925 | S | 7/2015 | Collier | |
| D779,644 | S | 2/2017 | Waggoner | |
| 2008/0216227 | A1 * | 9/2008 | Felmeri | A47K 17/024 4/511 |
| 2020/0069122 | A1 | 3/2020 | Edwards et al. | |

FOREIGN PATENT DOCUMENTS

| | | | |
|---|---|---|---|
| JP | H10-245957 | A | 9/1998 |
| JP | 2006-263023 | A | 10/2006 |
| KR | 20090048769 | A | 5/2009 |
| TW | M332462 | U | 5/2008 |

OTHER PUBLICATIONS

American Specialties, Inc. Technical Data Sheet. "Swing-Up Grab Bar". Revised Jul. 8, 2016.

Bobrick Washroom Equipment, Inc. Technical Data Sheet. "Swing-Up Grab Bar". Revised Sep. 1, 2017, USA.

Bobrick Washroom Equipment, Inc. Technical Data Sheet. "Vinyl-Coated Swing up Bar". Revised Oct. 17, 2017, USA.

Bradley 8372-107 Grab Bar, posted atwashroomdirectsales.com, posting date not given, [online], [site visited Jun. 24, 2020], Available from Internet, URL: https://www.washroomdirectsales.com/best-sellers/bradley-8372-107-1-diameter-stainless-steel-safety-grip-swing-up-grab-bar-30-long (Year: 2020).

Gamco Commercial Restroom Accessories. Technical Data Sheet. "1 1/4" (32mm) Diameter Swing up Bar". Revised Nov. 9, 2015, USA.

International Search Report and Written Opinion for International Application No. PCT/US2019/067153, dated Mar. 17, 2020, 14 pages.

MOEN 30 in. Flip-up Screw Grab Bar, posted at homedepot.com, posting date by Feb. 7, 2013, [online], [site visited Jun. 24, 2020], Available from Internet, URL: https://www.homedepot.eom/p/MOEN-30-in-x-1-1-4-i n-Fli p-up-Screw-Grab-Bar-i n-Peened-Stainless-Steel-R8960FD/203623691 (Year: 2013).

Satin Stainless Steel Folding Grab bar, posted at grab-bar.com, posting date not given, [online], [site visited Jun. 24, 2020], Available from Internet, URL: https://www.grab-bar.com/products/satin-stainless-steel-135-degree-angle-grab-bar-and-cover-flange (Year: 2020).

Swing-Up Grab Bar, posted at site.bradleycorp.com, posting date not given, [online], [site visited Jun. 24, 2020], Available from Internet, URL: https://site.bradleycorp.com/accessories/commercial/grabbar/swing-up-grab-bar-30-length (Year: 2020).

* cited by examiner

GRAB BAR FOR SUPPORT IN VARIOUS ENVIRONMENTS

CROSS-REFERENCE TO RELATED APPLICATION

This application claims the benefit of and priority to U.S. Provisional Patent Application No. 62/785,992, entitled "Grab Bar for Support in Various Environments," filed Dec. 28, 2018, the content of which is hereby incorporated by reference in its entirety.

TECHNICAL FIELD

The present disclosure relates generally to grab bars and more particularly to swing-up grab bar assemblies that can be used in lavatories to provide balance and support to users.

BACKGROUND

Grab bars are often located in lavatories, such as washrooms, bathrooms, and showers to help facilitate a user maneuvering within and through the lavatory. Grab bars can extend away from a sturdy mounting surface (e.g., a floor, wall, ceiling, etc.) to form an elongate structure capable of supporting or at least partially supporting the weight of a user. In use, a user can grab or otherwise engage the grab bar, which transfers at least a portion of the bodyweight of the user onto the grab bar. The user can then balance and support himself or herself partially or entirely on the grab bar as the user traverses or otherwise orients himself or herself within a bathroom stall or shower, for example.

Grab bars can be particularly useful for people with physical disabilities. For example, grab bars provide a sturdy structure that can support at least some of the bodyweight of a user as the user transitions from, for example, a wheel chair or power chair to a toilet or shower seat. The grab bar can similarly support at least some of the bodyweight of the user as the user transitions from, for example, the toilet or shower seat back into the wheel chair or power chair.

SUMMARY

One implementation of the present disclosure is a grab bar. The grab bar includes a continuous support bar extending between a first end and a second end vertically spaced apart from the first end. The continuous support bar has a top section extending away from the first end. A bottom section of the continuous support bar extends away from the second end and angles upward toward the top section. A bend is formed between and connects the top section and the bottom section. The grab bar includes a brace member coupled to and extending between the top section and the bottom section.

In some embodiments, the bottom section angles upward toward the top section to form an angle of between about 3 degrees and about 20 degrees with the top section. In some examples, the bottom section angles upward to form an angle of between about 5 degrees and about 10 degrees, and optionally between about 6 degrees and about 8 degrees. In some embodiments, the bend extends tangentially away from the top section at a top end and tangentially away from the bottom section at a bottom end. The bend can be defined by an angle greater than 150 degrees.

In some embodiments, the bottom section of the continuous support bar includes a first section and a second section. The first section extends away from the second end, and the second section extends away from the bend toward the first section. A bottom bend can be formed between the first section and the second section. In some examples, the first section extends away from the second end approximately parallel to the top section of the continuous support bar. The brace member can extend perpendicularly between the top section and the first section of the bottom section. In some embodiments, the brace member is coupled to the bottom section proximate the bottom bend. For example, the brace member can be coupled to the first section of the bottom section proximate the bottom bend. In some embodiments, the second section is longer than the first section.

In some embodiments, the brace member is a vertical bar extending perpendicular to the top section of the continuous support bar. A second brace member can also be coupled to the top section and the bottom section of the continuous support bar. The second brace member spans the top section and the bottom section of the continuous support bar. In some embodiments, the brace member has a triangular shape. A base of the triangular shape can extend coincidentally with the top section of the continuous support bar.

In some embodiments, the grab bar further includes a crossbar coupled to the first end of the continuous support bar. The crossbar can be used to pivotably couple the grab bar to a support base.

Another embodiment relates to a swing-up grab bar assembly. The swing-up grab bar includes a grab bar and a support member. The grab bar includes a continuous support bar extending between a first end and a second end vertically spaced apart from the first end. The continuous support bar has a top section extending away from the first end. A bottom section of the continuous support bar extends away from the second end and angles upward toward the top section. A bend is formed between and connects the top section and the bottom section. The grab bar includes a brace member coupled to and extending between the top section and the bottom section. A cross member is coupled to the first end and extends outward, orthogonally, beyond the top section in two opposing directions to form a pivot pin. The support member has collars spaced apart from one another. The collars extend perpendicularly away from a support base, and each receive a portion of the pivot pin. The collars and the pivot pin collectively form a pivotable coupling between the support member and the grab bar.

In some embodiments, at least one mounting hole is formed through the support base. Couplings can also be used to secure ends of the pivot pin to the collars.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
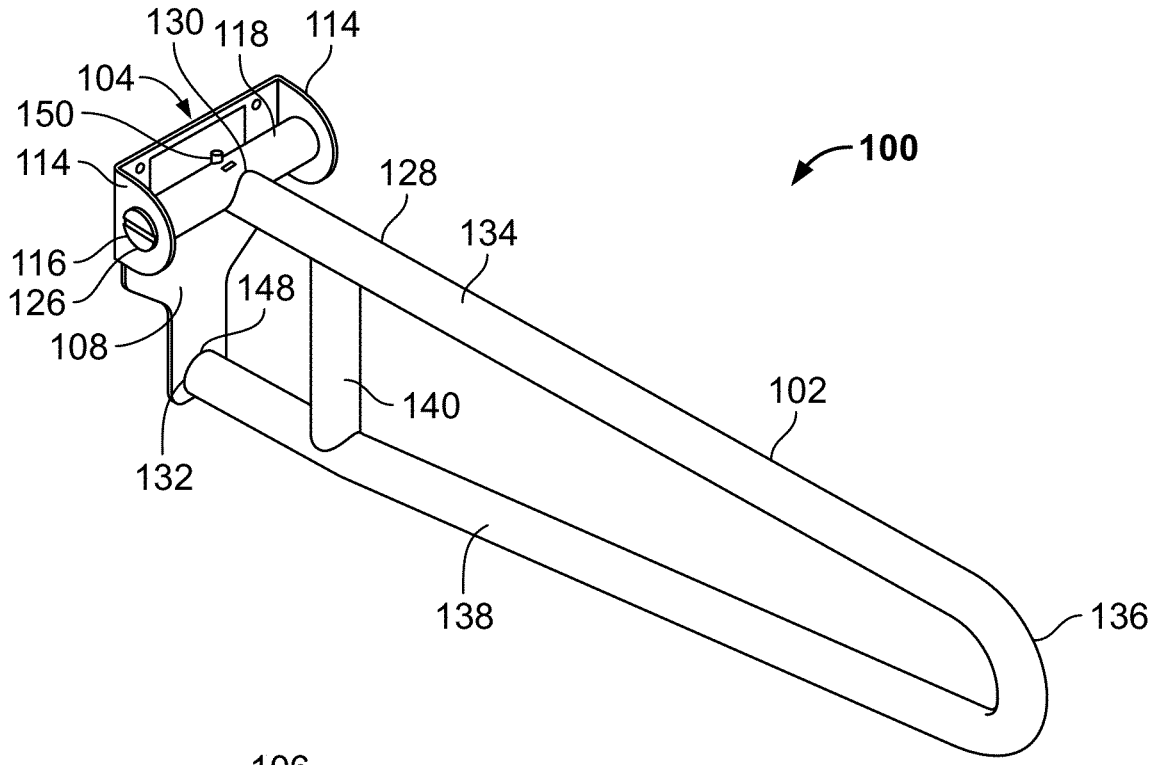
FIG. 1 is a perspective view of a swing-up grab bar assembly, according to an exemplary embodiment.

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, swing-up grab bar assemblies and grab bars for use in swing-up grab bar assemblies are shown according to various exemplary embodiments herein. The swing-up grab bar assemblies and grab bars can be located in lavatories, such as washrooms, bathrooms, and/or showers, for example, to help facilitate user maneuvering within and through the lavatories. The swing-up grab bar assemblies and grab bars can be formed of corrosion-resistant materials, including stainless steel, aluminum, nickel, or brass, for example. Coatings made from polymeric, metallic (e.g., chrome), ceramic, or a combination of these materials can be applied to the grab bar to further restrict corrosion and provide additional grip for a user. Texturing processes, including peening and blasting, can also be applied to the outer surfaces of the grab bars to provide additional grip for a user. In use, a user can grab or otherwise engage the grab bar in the swing-up grab bar assembly, which transfers at least a portion of the bodyweight of the user onto the grab bar. The user can then balance and support himself or herself partially or entirely on the grab bar as the user traverses or otherwise orients himself or herself within a bathroom stall or shower, for example.

Applicant has determined that the swing-up grab bar assemblies and grab bars for use in swing-up grab bar assemblies according to the present disclosure handle and distribute loading more proficiently than prior art grab bar designs, which increases the lift capacity of each grab bar and swing-up grab bar assembly. Each grab bar has a continuous support bar that is shaped to provide a grabbing section and a supporting section. The continuous nature of the support bar distributes loading experienced by the grabbing section (e.g., through a user grabbing and supporting bodyweight on the grabbing section) to the supporting section, which can in turn distribute loading to a support member and a mounting surface that the assembly is coupled to. One or more brace members help to transfer loading from the grabbing section to the supporting section as well. These and other features and advantages of the grab bars and swing-up grab bar assemblies are described in greater detail below.

Referring now to FIGS. 1-6, a swing-up grab bar assembly 100 is depicted according to one embodiment. The swing-up grab bar assembly 100 includes a grab bar 102 and a support member 104. The grab bar 102 is pivotably coupled to the support member 104, which enables the grab bar 102 to transition between a stowed position (shown in dashed lines in FIG. 2) and a deployed position (shown, e.g., in FIGS. 1-2). In the deployed position, the grab bar 102 can be engaged by a user to support at least some of the bodyweight of the user. Once use has been completed, the user can push the grab bar 102 upward, to the stowed position, where the grab bar 102 has a smaller horizontal footprint. The grab bar 102 is not typically intended to support the bodyweight of a user in the stowed position. The support member 104 is coupled to a mounting surface (e.g., a wall, floor, ceiling, etc.) 106, which can constrain the allowable rotational motion of the grab bar 102 relative to the support member 104, as explained below. In some embodiments, a bumper (not shown) is also coupled to the mounting surface 106 above the support member 104 to contact and support the grab bar 102 in the stowed position.

The support member 104 can be a bracket, for example, that includes a support base 108 that is readily securable to a mounting surface 106. The support base 108 includes a generally flat rear surface 110 that enables the support base 108 to mount flush against any suitable mounting surface (e.g, mounting surface 106). Mounting holes 112 are formed through the support base 108 to facilitate the coupling process between the support member 104 and a mounting surface 106. Fasteners (not shown) can extend through the mounting holes 112 to secure the support base 108, and therefore the support member 104, to the mounting surface 106. Alternatively, the support member 104 can be adhesively or otherwise rigidly coupled (e.g., welded) to the mounting surface 106.

In the example shown, collars 114 extend away from the support base 108 to receive and support the grab bar 102. In some embodiments, the support base 108 includes two collars 114 spaced apart from one another on separate sides of the support base 108. The collars 114 extend perpendicularly away from the support base 108 and the rear surface 110, collectively, to define a pivot support. The pivot support can receive a pivot pin (e.g., the pivot pin 118) through apertures 116 formed through each collar 114. The apertures 116 can be axially aligned with one another to define a passageway extending transversely across the support base 108 and through each collar 114. In other embodiments, more or less than two collars 114 can extend away from the support base 108. Optionally, the grab bar 102 can be coupled to the support base using a hinge pin (not shown) that extends through collars 114 formed in the support member 104 and collars (not shown) extending away from the grab bar 102. In some embodiments, collars 114 are omitted and the grab bar 102 is welded or otherwise rigidly coupled to the support base 108 to remain in the deployed position at all times.

The grab bar 102 is shown to include a pivot pin 118 that interacts with the pivot support to couple the grab bar 102 to the support member 104. The pivot pin 118 can be formed of round stock or round tube, for example, that is sized to form a tight clearance fit with the apertures 116 in each collar 114. When assembled, an end 120, 122 of the pivot pin 118 extends through the aperture 116 in each collar 114. In some embodiments, couplings 124 (e.g., rivets or other fasteners) are used to help secure the pivot pin 118 to the support member 104. For example, couplings 124 could engage each end 120, 122 of the pivot pin 118 and an outer surface 126 of each collar 114 to ensure the pivot pin 118 remains properly positioned relative to the support base 108, within the pivot support.

Figure 2:
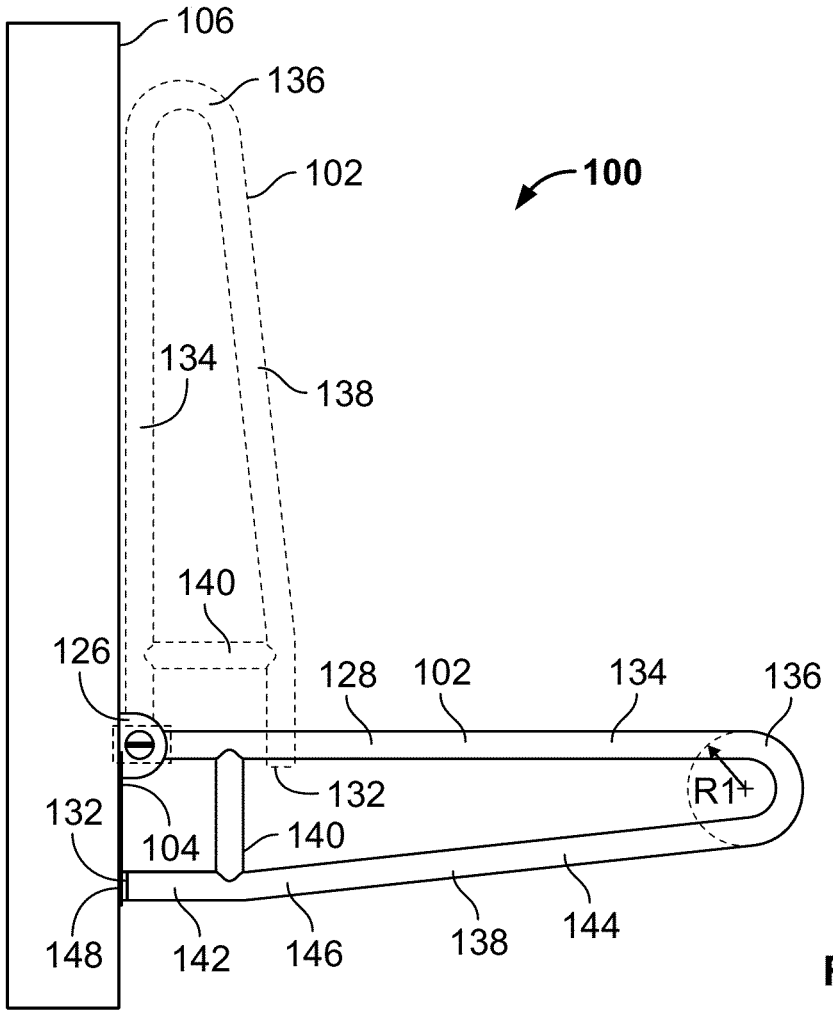
FIG. 2 is a side view of the swing-up grab bar assembly of FIG. 1.
Figure 3:
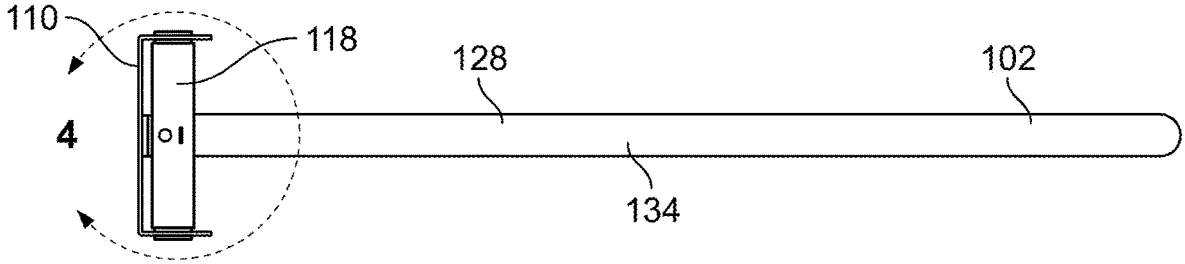
FIG. 3 is a top view of the swing-up grab bar assembly of FIG. 1.
Figure 4:
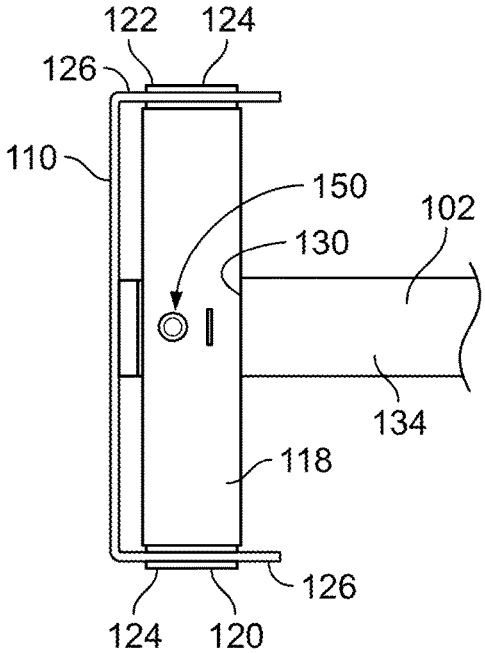
FIG. 4 is a detailed view of the interaction between the grab bar and the support member in the swing-up grab bar assembly of FIG. 1, taken along from dashed arc 4 in FIG. 3.
Figure 5:
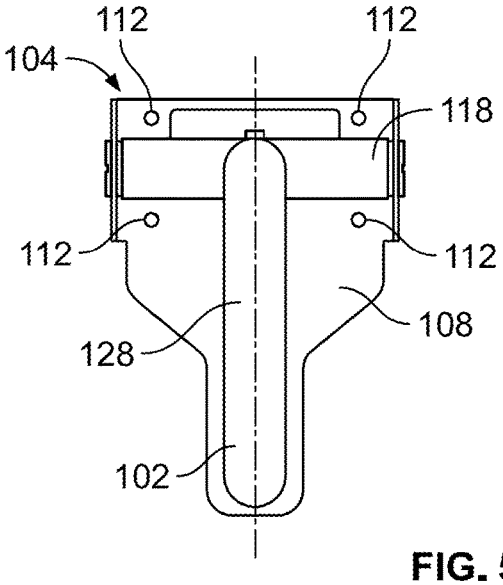
FIG. 5 is a front view of the swing-up grab bar assembly of FIG. 1.

The clearance fit between the apertures 116 and the pivot pin 118 allows the pivot pin 118 to rotate relative to the collars 114 and the support base 108. The pivot pin 118 can also be rigidly coupled (e.g., welded) to the grab bar 102, which allows the grab bar 102 to rotate in concert or unison with the pivot pin 118. Accordingly, rotation between the pivot pin 118 and the pivot support can also rotate the grab bar 102 relative to the base member 104 and the mounting surface 106 between the stowed and deployed positions, as depicted in FIG. 2.

The pivot pin 118 can be coupled to a continuous support bar 128 that at least partially defines an outer perimeter of the grab bar 102. The continuous support bar 128 can be formed of corrosion-resistant round stock or round tubing (e.g., 18 gauge stainless steel tubing) that is bent into a structure suitable for supporting loads typically associated with the bodyweight of a user. In some examples, the continuous support bar 128 is shaped (e.g., bent) using a mandrel bending process that maintains a uniform bar diameter throughout the continuous support bar 128.

The continuous support bar 128 has a first end 130 and a second end 132 vertically spaced apart from the first end 130. A top or "grabbing" section 134 extends away from the first end 130 of the continuous support bar 128 to a top bend 136. At the top bend 136, the continuous support bar 128 curves downwardly away from the top section 134 to a bottom or "supporting" section 138. The bottom section 138 angles downwardly, away from the top bend 136 and away from the top section 134, to the second end 132. A brace member 140 extends between the top section 134 and the bottom section 138. The brace member 140 can be rigidly coupled (e.g., welded, fastened, adhesively coupled, etc.) to each of the top section 134 and the bottom section 138, as explained below.

The top section 134 of the continuous support bar 128 extends longitudinally away from the first end 130 to provide a consistent, cylindrical gripping surface. For example, the top section 134 can be arranged so that the top section 134 extends perpendicularly or approximately perpendicularly (e.g., within about 5 degrees) away from the mounting surface 106 in the deployed orientation. In the stowed orientation, the top section 134 can extend parallel to or approximately parallel to the mounting surface 106.

The top bend 136 can extend tangentially away from the top section 134 to avoid introducing unnecessary stress risers into the continuous support bar 128. The top bend 136 can be defined by a constant or near-constant radius R1, for example. In some embodiments, the top bend 136 extends about the reference circle defined by R1 to form a bend angle of between about 150 degrees and about 180 degrees. Alternatively, the top bend 136 can be defined by a variable radius having a bend angle greater than 150 degrees.

Figure 6:
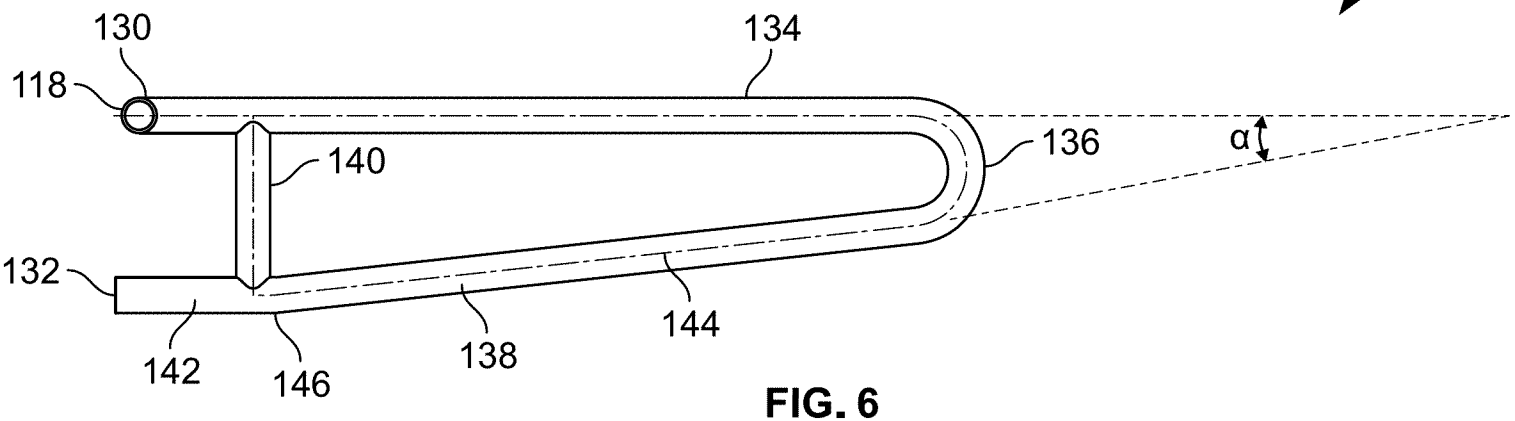
FIG. 6 is a side view of a grab bar of the swing-up grab bar assembly of FIG. 1.

The bottom section 138 can also extend tangentially away from the top bend 136. As illustrated in FIG. 6, the bottom section 138 angles downwardly away from the top bend 136 and downwardly away from the top section 134 toward the second end 132. The angle $\alpha$ at which the bottom section 138 angles away from the top section 134 can be influenced by or directly correlated to the bend angle of the top bend 136. For example, the grab bar 102 is illustrated having a bend angle of 173 degrees, which in turn forms an angle $\alpha$ between the top section 134 and the bottom section 138 of about 7 degrees. In other embodiments, the angle $\alpha$ is between about 3 degrees and about 20 degrees, or between about 5 degrees and about 10 degrees.

The bottom section 138 is further defined by a first section 142 and a second section 144 that are separated by a bottom bend 146. The first section 142 extends away from the second end 132 to the bottom bend 146. The second section 144 can extend away from the bottom bend 146 to the top bend 136. In some embodiments, the first section 142 extends away from the second end 132 approximately parallel to the top section 134 of the continuous support bar 128. The second section 144, as illustrated, is longer than the first section 142. The second section 144 can extend upwardly away from the bottom bend 146 toward the top bend 136 at the angle $\alpha$ with respect to the top section 134. In some embodiments, the angle $\alpha$ corresponds to a bend angle defining the bottom bend 146. By extending toward the top section 134 at the angle $\alpha$, the second section 144, top bend 136, and top section 134 can collectively form a triangular truss. Applicant has determined that this structure may effectively distribute loading experienced in various locations on the grab bar 102 throughout the continuous support bar 128. By effectively handling and distributing stresses experienced by the grab bar 102, the triangular truss shape can improve the overall load capacity and lifetime of the grab bar 102 over other grab bars currently in use.

In some embodiments, the brace member 140 extends from the first section 142 of the bottom section 138 upward to the top section 134 of the continuous support bar 128. As shown, the brace member 140 can be a vertical bar (e.g., formed of round tube stock or round stock) that extends perpendicularly between the first section 142 and the top section 134, for example. The brace member 140 can be located proximate (i.e., adjacent to, abutting, or even slightly overlapping) the bottom bend 146. The brace member 140, as depicted, is positioned at an axial distance away from the first 130 that is between about seven and eight times smaller than a total axial length of the top section 134. As explained below, additional brace members and alternative brace member structures can also be used in the swing-up grab bar assembly 100.

The grab bar 102 can also include features that interact with the support member 104 to translate and distribute loading experienced by the grab bar 102 to the support member 104 and to align the grab bar 102 relative to the support member 104. For example, a bumper 148 can be coupled to the second end 138 or to the support base 108. The bumper 148 can be formed of a resilient material, for example, which can be cyclically engaged and disengaged with the support base 108 as the grab bar 102 is transitioned between stowed and deployed orientations. The bumper 148 can also ensure that loading experienced by the bottom section 138 is properly distributed to the support base 108. When loaded by the bottom section 138, the bumper 148 can deflect to increase the contact area between the support base 108 and the grab bar 102, which reduces the potential for point loading that might otherwise occur if metal-to-metal contact was being made between the second end 138 and the support base 108. The bumper 148 can restrict the allowable rotational motion of the grab bar 102 relative to the support member 104. For example, the bumper 148 can be positioned on the second end 138 to engage the support base 108 at a point where the top section 134 extends perpendicularly away from the mounting surface 106 and the support base 108, which restricts further allowable downward rotation.

The pivot pin 118 can also interact with the support member 104 to create a pivotable coupling between the grab bar 102 and the support member 104. The pivot pin 118 may take the form of a crossbar that is coupled to the first end 130 of the continuous support bar 128. The pivot pin 118 can extend orthogonally relative to the continuous support bar 128 so that both the first end 120 and the second end 122 of the pivot pin 118 extend outward beyond the outer surface of the continuous support bar 128. In some embodiments, the coupling between the first end 130 of the continuous support bar 128 and the pivot pin 118 occurs at approximately the axial midpoint of the pivot pin 118. The pivot pin 118 is received within the collars 114 of the support member 104, which couples the grab bar 102 to the support base 108 and support member 104 generally. In some embodiments, the pivot pin 118 includes a cap screw 150 that can interact with the support base 108 to help maintain the pivot pin 118 (and grab bar 102) in a desired orientation (e.g., stowed and extending upward) with respect to the mounting surface 106 and support member 104. In the stowed position, the cap screw 150 can extend outward from the pivot pin 118 to engage the support base 108 and resist movement of the grab bar 102 from the stowed position to the deployed position. The engagement between the cap screw 150 and the support base 108 can prevent or at least reduce the likelihood that the grab bar 102 will deploy accidentally. The degree of engagement can be limited, however, so that a very small force (e.g., 5 lbf) can sufficiently overcome the resistance of the cap screw 150 and support base 108 to deploy the grab bar 102.

Referring now to FIGS. 7-17, additional grab bars 202, 302, 402, 502, 602, 702, 802, 902, 1002, 1102, 1202 according to the present disclosure are depicted. Each of the grab bars 202, 302, 402, 502, 602, 702, 802, 1002, 1102, 1202 can be coupled to the support member 104, for example, to operate in a swing-up grab bar assembly the same as or similar to the swing-up grab bar assembly 100 described in detail above. The grab bars 202, 302, 402, 502, 602, 702, 802, 902, 1002, 1102, 1202 can be made of corrosion-resistant materials, including bent stainless steel tube stock or round stock, for example.

As shown in FIGS. 7-15, each grab bar 202, 302, 402, 502, 602, 702, 802, 902, 1002 includes a continuous support bar 228, 328, 428, 528, 628, 728, 828, 928, 1028 extending between a first end 230, 330, 430, 530, 630, 730, 830, 930, 1030 and a second end 232, 332, 432, 532, 632, 732, 832, 932, 1032 vertically spaced apart from the first end 230, 330, 430, 530, 630, 730, 830, 930, 1030. A top or "grabbing" section 234, 334, 434, 534, 634, 734, 834, 934, 1034 extends away from the first end 230, 330, 430, 530, 630, 730, 830, 930, 1030 of the continuous support bar 228, 328, 428, 528, 628, 728, 828, 928, 1028 to a top bend 236, 336, 436, 536, 636, 736, 836, 936, 1036. At the top bend 236, 336, 436, 536, 636, 736, 836, 936, 1036 the continuous support bar 228, 328, 428, 528, 628, 728, 828, 928, 1028 curves downwardly away from the top section 234, 334, 434, 534, 634, 734, 834, 934, 1034 to a bottom or "supporting" section 238, 338, 438, 538, 638, 738, 838, 938, 1038. The bottom section 238, 338, 438, 538, 638, 738, 838, 938, 1038 angles downwardly, away from the top bend 236, 336, 436, 536, 636, 736, 836, 936, 1036 and away from the top section 234, 334, 434, 534, 634, 734, 834, 934, 1034, to the second end 232, 332, 432, 532, 632, 732, 832, 932, 1032. A brace member 240, 340, 440, 540, 640, 740, 840, 940, 1040 extends between the top section 234, 334, 434, 534, 634, 734, 834, 934, 1034 and the bottom section 238, 338, 438, 538, 638, 738, 838, 938, 1038. The brace member 240, 340, 440, 540, 640, 740, 840, 940, 1040 can be rigidly coupled (e.g., welded) to each of the top section 234, 334, 434, 534, 634, 734, 834, 934, 1034 and the bottom section 238, 338, 438, 538, 638, 738, 838, 938, 1038.

Figure 7:
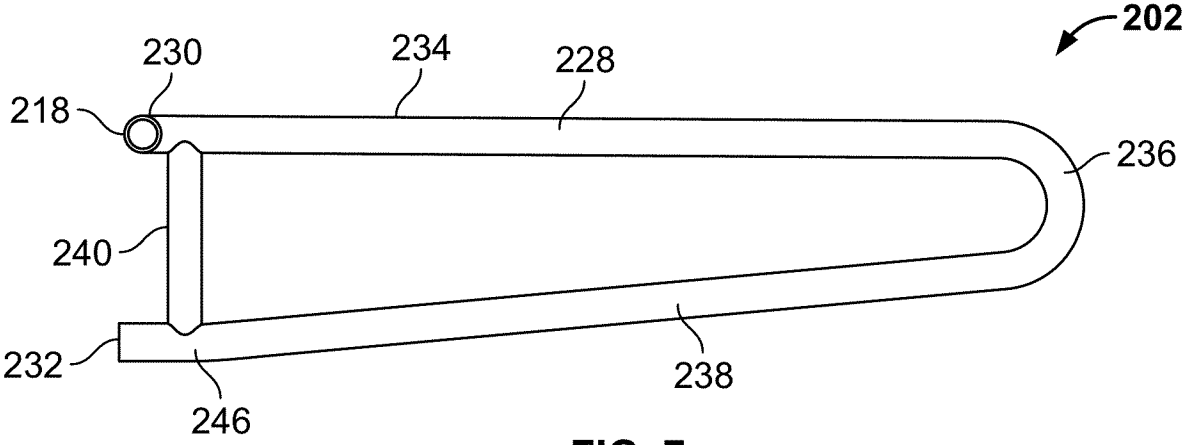
FIG. 7 is a side view of another embodiment of a grab bar that can be incorporated into a swing-up grab bar assembly, such as the swing-up grab bar assembly of FIG. 1.
Figure 8:
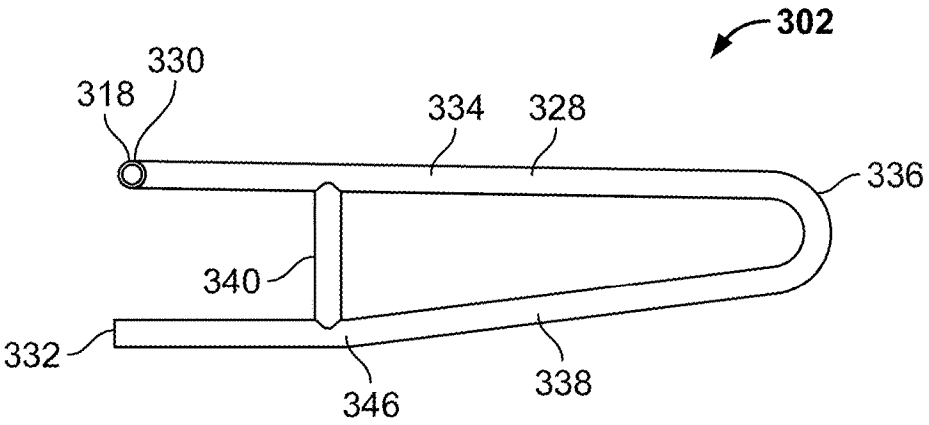
FIG. 8 is a side view of another embodiment of a grab that can be incorporated into a swing-up grab bar assembly, such as the swing-up grab bar assembly of FIG. 1.
Figure 9:
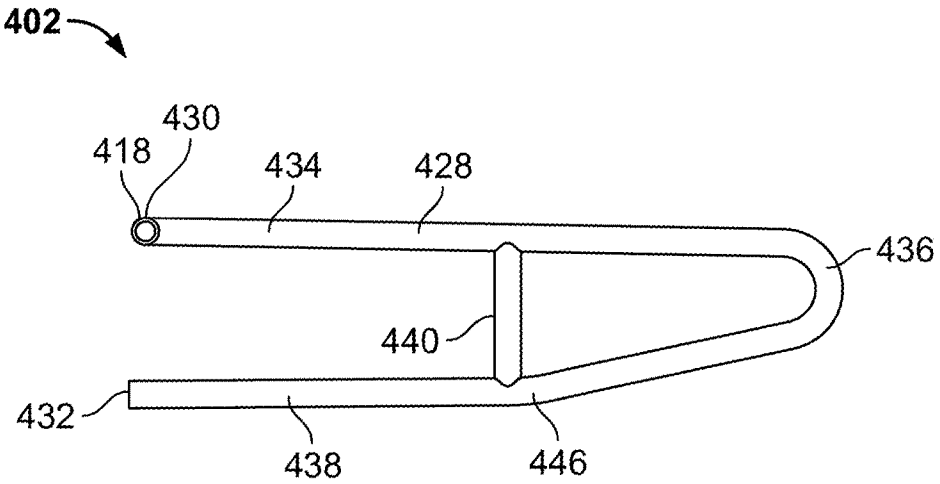
FIG. 9 is a side view of another embodiment of a grab bar that can be incorporated into a swing-up grab bar assembly, such as the swing-up grab bar assembly of FIG. 1.

FIGS. 7-9 depict grab bars 202, 302, 402 having similar or identical components to the grab bar 102, but with positional relationships altered to adjust the total loading capacity. For example, the location of the brace member 240, 340, 440 and a bottom bend 246, 346, 446 can be altered relative to the first end 230, 330, 430 and second end 232, 332, 432 to adjust the length of the triangular truss formed by the grab bar 202, 302, 402. As shown specifically in FIG. 7, the grab bar 202 includes a brace member 240 that is positioned proximate the first end 230 and the second end 232. The brace member 240 is coupled to the top section 234 at a location nearly tangent to a pivot pin 218 coupled to the first end 230. The brace member 240 is coupled to the top section 234 at an axial distance from the first end 230 that is over ten times smaller than the total axial length of the top section 234. In FIG. 8, the brace member 340 and bottom bend 346 are moved forward, away from the first end 330 and second end 332. The brace member 340 is coupled to the top section 334 at an axial distance from the first end 330 that is between about three and four times smaller than the total axial length of the top section 334. As shown in FIG. 9, the brace member 440 and bottom bend 446 can be moved even further forward, so the brace member 440 contacts the top section 434 at an axial distance from the first end 430 that is over half the total axial length of the top section 434.

Figure 10:
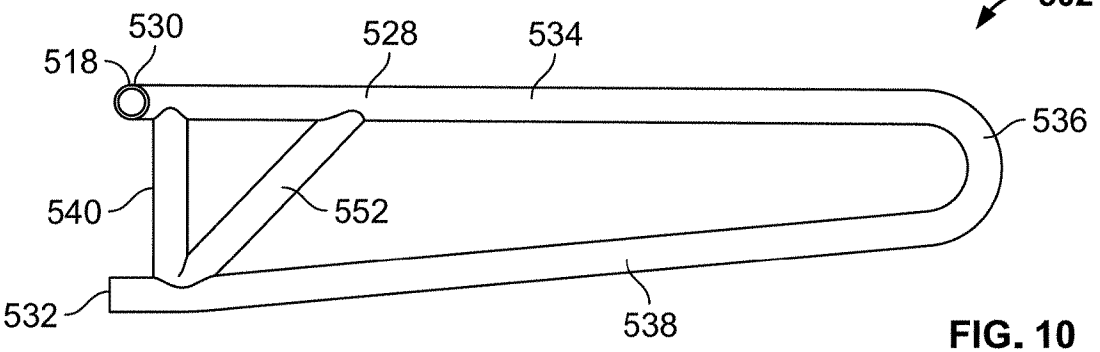
FIG. 10 is a side view of another embodiment of a grab bar that can be incorporated into a swing-up grab bar assembly, such as the swing-up grab bar assembly of FIG. 1.
Figure 11:
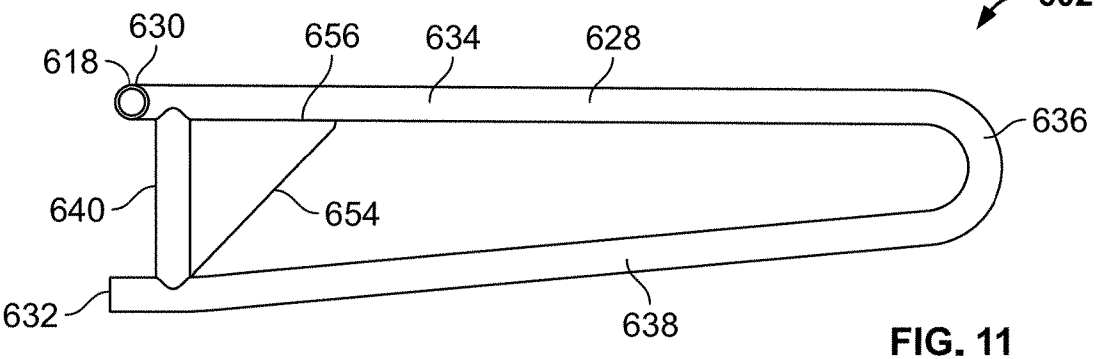
FIG. 11 is a side view of another embodiment of a grab bar that can be incorporated into a swing-up grab bar assembly, such as the swing-up grab bar assembly of FIG. 1.
Figure 12:
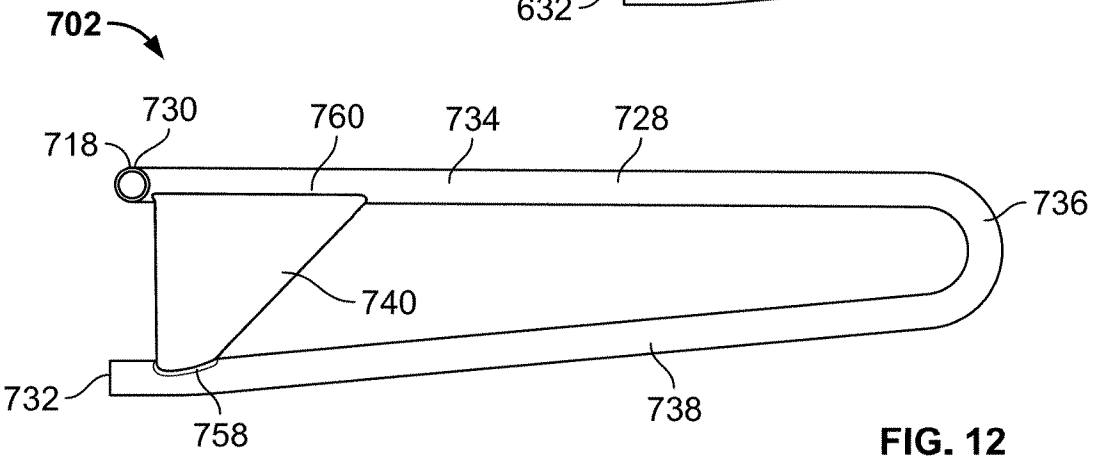
FIG. 12 is a side view of another embodiment of a grab bar that can be incorporated into a swing-up grab bar assembly, such as the swing-up grab bar assembly of FIG. 1.
Figure 13:
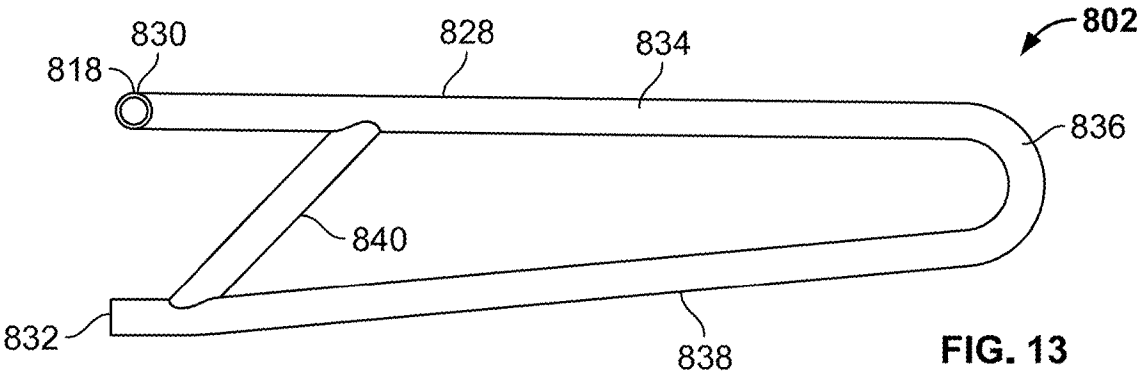
FIG. 13 is a side view of another embodiment of a grab bar that can be incorporated into a swing-up grab bar assembly, such as the swing-up grab bar assembly of FIG. 1.
Figure 14:
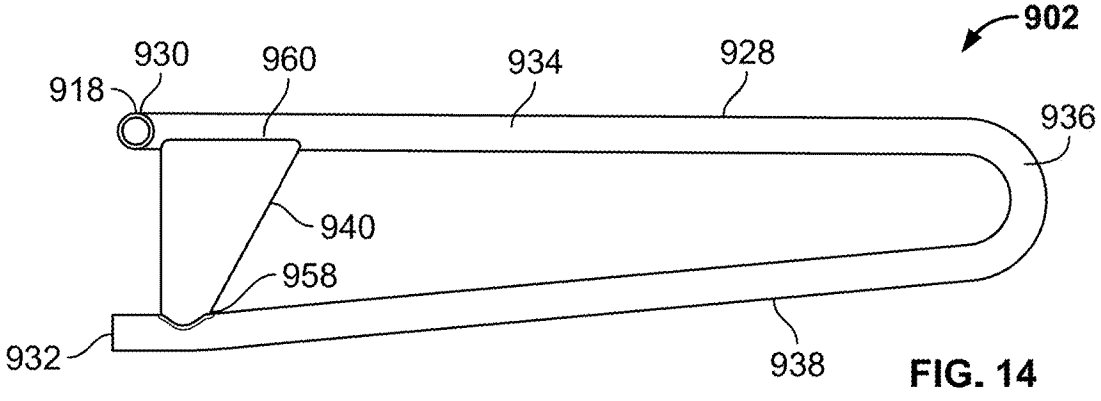
FIG. 14 is a side view of another embodiment of a grab bar that can be incorporated into a swing-up grab bar assembly, such as the swing-up grab bar assembly of FIG. 1.
Figure 15:
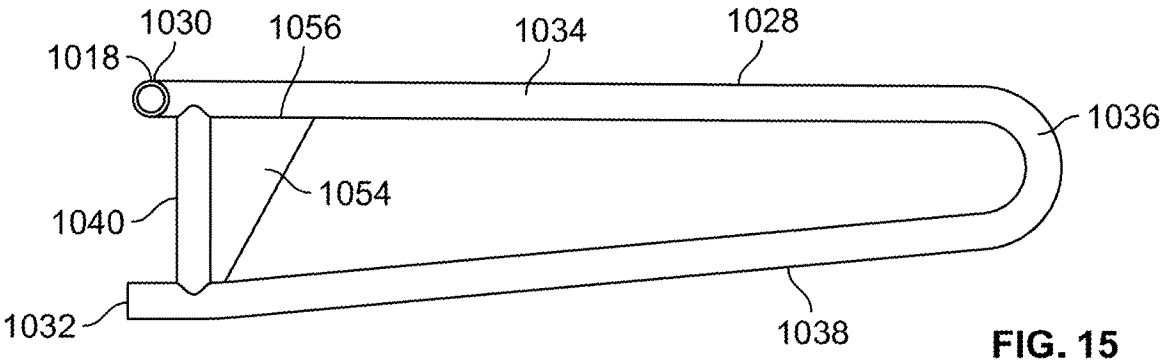
FIG. 15 is a side view of another embodiment of a grab bar that can be incorporated into a swing-up grab bar assembly, such as the swing-up grab bar assembly of FIG. 1.

As shown in FIGS. 10-15, different brace members 540, 640, 740, 840, 940, 1040 can be used to reinforce the continuous support bars 528, 628, 728, 828, 928, 1028 between their respective top sections 534, 634, 734, 834, 934, 1034 and bottom sections 534, 634, 734, 834, 934, 1034. As shown in FIG. 10, a vertical brace member 540 and an angled brace member 552 can each extend between the top section 534 and the bottom section 538 of the continuous support bar 528. In some embodiments, the vertical brace member 540 and the angled brace member 552 are each coupled to the bottom section 538 of the continuous support bar 528 at a common location. The angled brace member 552 can extend forwardly and upwardly away from the bottom section 538 to the top section 534. In FIGS. 11 and 15, a vertical brace member 640, 1040 and a triangular brace plate 654, 1054 each extend between the top section 634, 1034 and the bottom section 638, 1038 of the continuous support bar 628, 1028. A base 656, 1056 of the triangular base plate 654, 1054 can extend coincidentally with the top section 634, 1034 of the continuous support bar 628, 1028. The sizes of the triangular base plate 654, 1054 can be varied, which may affect the capacity of each grab bar 602, 1002. As shown in FIGS. 12 and 14, the brace member 740, 940 is a triangular base plate. A vertex 758, 958 of the triangular base plate 740, 940 can be coupled to the bottom section 738, 938 of the continuous support bar 728, 928 and a base 760, 960 of the triangular base plate 740, 940 opposite the vertex 758, 958 can extend coincidentally with the top section 734, 934 of the continuous support bar 728, 928. The length of the base 760, 960 can be adjusted based upon a desired lifting capacity for the grab bar 702, 902. As shown in FIG. 13, the brace member 840 can be an angled brace member extending between the top section 834 and the bottom section 838 of the continuous support bar 828. The angled brace member 840 extends forwardly and upwardly away from the bottom section 838 to the top section 834 of the continuous support bar 828.

Figure 16:
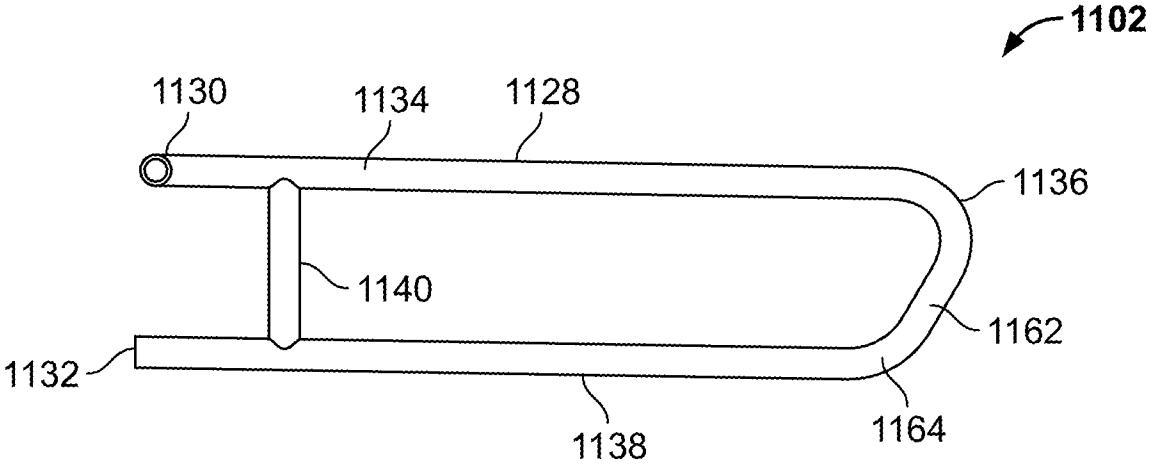
FIG. 16 is a side view of another embodiment of a grab bar that can be incorporated into a swing-up grab bar assembly, such as the swing-up grab bar assembly of FIG. 1.
Figure 17:
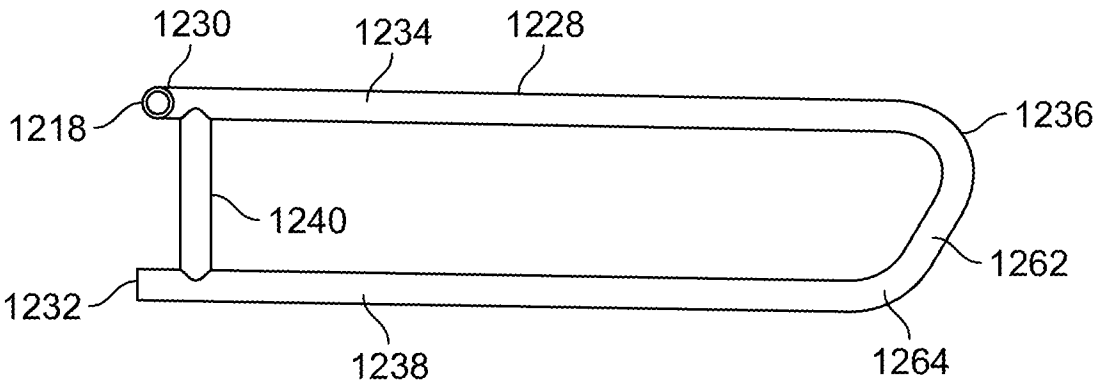
FIG. 17 is a side view of another embodiment of a grab bar that can be incorporated into a swing-up grab bar assembly, such as the swing-up grab bar assembly of FIG. 1.

Referring now to FIGS. 16 and 17, still additional embodiments of a grab bar 1102, 1202 are provided. The grab bars 1102, 1202 can be defined by continuous support bars 1128, 1228 that extend away from a first end 1130, 1230 to provide a top section 1134, 1234. The top section 1134, 1234 extends away from the first end 1130, 1230 to a top bend 1136, 1236 that curves downwardly away from the top section 1134, 1234. A linear section 1162, 1262 angles downward and inward from the top bend 1136, 1236 to a bottom bend 1164, 1264. A bottom section 1138, 1238 extends away from the bottom bend 1164, 1264, approximately parallel to the top section 1134, 1234, to the second end 1132, 1232. A brace member 1140, 1240 in the form of a vertical bar can extend perpendicularly between the top section 1134, 1234 and the bottom section 1138, 1238 of the continuous support bar 1128, 1228. The location of the brace member 1140, 1240 can be adjusted to in turn adjust the capacity of the grab bar 1102, 1202.

Configuration of Exemplary Embodiments

It is important to note that the construction and arrangement of the swing-up grab bar assembly and the grab bars as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of certain elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A communicably "coupled" to circuit B may signify that the circuit A communicates directly with circuit B (i.e., no intermediary) or communicates indirectly with circuit B (e.g., through one or more intermediaries).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, or Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The invention claimed is:

1. A grab bar comprising:

a continuous support bar extending between a first end and a second end vertically spaced apart from the first end and having a triangular shape, the continuous support bar having:

a top section extending away from the first end;

a bottom section extending away from the second end and angling upward toward the top section, the bottom section including a first section extending away from the second end, a second section extending toward the first section, and a bottom bend formed between the first section and the second section; and a bend formed between and connecting the top section and the bottom section, wherein the second section extends away from the bend towards the first section; and a brace member coupled to and extending between the top section and the bottom section, the brace member being positioned proximate to the bottom bend of the bottom section.

2. The grab bar of claim 1, wherein the bottom section angles upward toward the top section to form an angle of between about 3 degrees and about 20 degrees with the top section.

3. The grab bar of claim 2, wherein the bottom section angles upward toward the top section to form an angle of between about 5 degrees and about 10 degrees with the top section.

4. The grab bar of claim 1, wherein the bend extends tangentially away from the top section at a top end and tangentially away from the bottom section at a bottom end.

5. The grab bar of claim 1, wherein the first section extends away from the second end approximately parallel to the top section of the continuous support bar.

6. The grab bar of claim 5, wherein the brace member extends perpendicularly between the top section and the first section of the bottom section.

7. The grab bar of claim 1, wherein the brace member is coupled to the top section and the first section of the bottom section.

8. The grab bar of claim 1, wherein the brace member is coupled to the first section of the bottom section.

9. The grab bar of claim 1, wherein the second section is longer than the first section.

10. The grab bar of claim 1, wherein the bend is defined by an angle greater than 150 degrees.

11. The grab bar of claim 1, wherein the brace member is a vertical bar extending perpendicular to the top section of the continuous support bar.

12. The grab bar of claim 11, further comprising a second brace member coupled to and extending between the top section and the bottom section of the continuous support bar.

13. The grab bar of claim 1, wherein the brace member has a triangular shape and at least one base of the triangular shape extends coincidentally with the top section of the continuous support bar.

14. The grab bar of claim 1, further comprising a crossbar coupled to the first end, the crossbar extending orthogonally relative to the continuous support bar.

15. The grab bar of claim 14, wherein the grab bar is pivotably coupled to a support base via the crossbar.

16. A swing-up grab bar assembly comprising:

a grab bar comprising:

a continuous support bar extending between a first end and a second end vertically spaced apart from the first end, the continuous support bar having:

a top section extending away from the first end;

a bottom section extending away from the second end and angling upward toward the top section, the bottom section including a first section extending away from the second end, a second section extending toward the first section, and a bottom bend formed between the first section and the second section; and a bend formed between and connecting the top section and the bottom section, wherein the second section extends away from the bend towards the first section;

a brace member coupled to and extending between the top section and the bottom section, the brace member being positioned proximate the bottom bend of the bottom section; and a cross member coupled to the first end and extending outward beyond the top section in two opposing directions to form a pivot pin; and a support member having collars spaced apart from one another and extending substantially perpendicularly away from a support base, the collars each receiving a portion of the pivot pin therein to form a pivotable coupling between the support member and the grab bar.

17. The swing-up grab bar assembly of claim 16, wherein the support base includes at least one mounting hole formed therethrough.

* * * * *